US005222546A

United States Patent [19]

Flemming

[11] Patent Number: 5,222,546

[45] Date of Patent: Jun. 29, 1993

[54] PLANT FOR MANUFACTURING STEEL STRIP

[75] Inventor: Günter Flemming, Erkrath, Fed. Rep. of Germany

[73] Assignee: SMS Schloemann Siemag Aktiengesellschaft, Dusseldorf, Fed. Rep. of Germany

[21] Appl. No.: 579,877

[22] Filed: Sep. 7, 1990

[30] Foreign Application Priority Data

Sep. 7, 1989 [DE] Fed. Rep. of Germany ..... 3929722

[51] Int. Cl.[5] ..... B22D 11/12; B22D 47/00

[52] U.S. Cl. ..... 164/484; 164/454; 164/441

[58] Field of Search ..... 164/454, 476, 484, 417, 164/442, 441, 477

[56] References Cited

U.S. PATENT DOCUMENTS

| | | | |
|---|---|---|---|
| 2,988,790 | 6/1961 | Rustemeyer | 164/442 |
| 3,773,099 | 11/1973 | Rossi | 164/442 |
| 3,812,900 | 5/1974 | Bollig | 164/454 |
| 3,837,391 | 9/1974 | Rossi | 164/442 |
| 4,122,888 | 10/1978 | Pühringer | 164/484 |
| 4,633,933 | 1/1987 | Colombo | 164/460 |
| 4,658,882 | 4/1987 | Oba | 164/417 |
| 4,817,703 | 4/1989 | Rohde | 164/417 |

FOREIGN PATENT DOCUMENTS

| | | | |
|---|---|---|---|
| 0327854 | 1/1989 | European Pat. Off. . | |
| 57-41869 | 3/1982 | Japan | 164/442 |
| 58-181457 | 10/1983 | Japan | 164/441 |
| 58-184053 | 10/1983 | Japan | 164/454 |
| 59-54455 | 3/1984 | Japan | 164/442 |
| 62-267051 | 11/1987 | Japan | 164/417 |

*Primary Examiner*—Richard K. Seidel
*Assistant Examiner*—Rex E. Pelto
*Attorney, Agent, or Firm*—Anderson Kill Olick & Oshinsky

[57] ABSTRACT

A plant for manufacturing steel strip in which the steel strip case in a mold is conducted into a horizontally arranged straightening conveyor and subsequently into a temperature equalizing furnace. For avoiding lateral deviations of the steel strip in the temperature equalizing furnace, an aligning station for the steel strip is arranged between the straightening conveyor and the temperature equalizing furnace.

3 Claims, 2 Drawing Sheets

PLANT FOR MANUFACTURING STEEL STRIP

BACKGROUND OF THE INVENTION

1. Field of the Invention

The present invention relates to a plant for manufacturing steel strip in which the steel strip cast in a mold is conducted into a horizontally arranged straightening conveyor and subsequently into a temperature equalizing furnace.

2. Description of the Related Art

In a known plant for manufacturing steel strip, a steel strip having a thickness of approximately 50 mm is cast in a vertically arranged mold and is deflected by means of a guide unit in an arc into a horizontal conveyor. The horizontal conveyor is arranged in a temperature equalizing furnace. As a result, it is possible to use the cast steel strip directly in a subsequently arranged hot rolling mill.

In this known plant for manufacturing steel strip, it is a problem that the steel strip emerges horizontally from the strip casting machine with lateral deviations, so that an alignment relative to the conveying direction of the subsequently arranged horizontal conveyor is not ensured. Thus, over the great length of the horizontal conveyor, it may occur that the strip moves off the rollers of the horizontal conveyor. Moreover, there are difficulties with respect to the initial pass in the subsequently arranged hot rolling mill.

SUMMARY OF THE INVENTION

It is the object of the present invention to provide a plant for manufacturing steel strip of the above-described type in which the difficulties mentioned above are eliminated. Specifically, a plant is to be provided in which lateral deviations of the cast steel strip on the horizontal conveyor are avoided and an exact initial pass in the subsequently arranged rolling mill is achieved.

In accordance with the present invention, this object is met by arranging an aligning station for the steel strip between the straightening conveyor and the temperature equalizing furnace.

The plant according to the present invention makes it possible to exactly insert the steel strip into the temperature equalizing furnace and to operate the initial pass in the subsequently arranged rolling mill without trouble.

In accordance with another feature of the present invention, the aligning station is formed by a support roller arranged downstream of the straightening conveyor and underneath the travel plane of the strip. The bearings of the support roller are vertically adjustable independently of each other. As a result, the steel strip is pulled into the correct path by unilaterally lifting with the tip thereof. Alternatively, a pair of drive rollers may be arranged downstream of the straightening conveyor, wherein adjacent bearings of the drive rollers are adjustable parallel to the strip travel plane independently of the other bearings.

In accordance with another feature, it is possible to align the steel strip by means of laterally heating or cooling the strip resulting in thermal expansion or shrinkage. For heating the strip, gas burners can be used which can be selectively switched on or can be moved directly over the strip surface. Partial cooling of the strip surface can be effected by means of conventional, selectively controllable spray nozzles.

In accordance with another feature of the invention, a method for operating an aligning station includes the steps of determining the horizontal conveying direction of the steel strip and comparing it with the conveying direction of the horizontal conveyor and correcting any lateral alignment error of the steel strip by horizontally aligning the strip.

The various features of novelty which characterize the invention are pointed out with particularity in the claims annexed to and forming a part of this disclosure. For a better understanding of the invention, its operating advantages attained by its use, reference should be had to the drawings and descriptive matter in which there are illustrated and described preferred embodiments of the invention.

DESCRIPTION OF THE PREFERRED EMBODIMENTS

Figure 1:
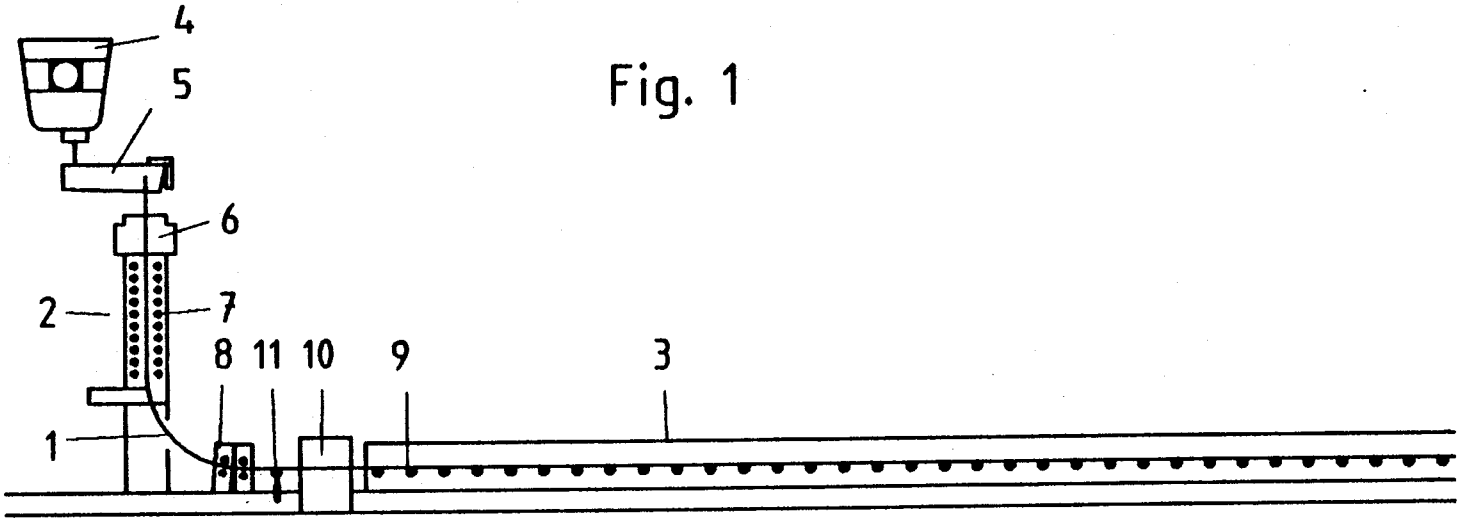
FIG. 1 is a schematic side elevational view of a plant for manufacturing steel strip including an aligning station.
Figure 2:
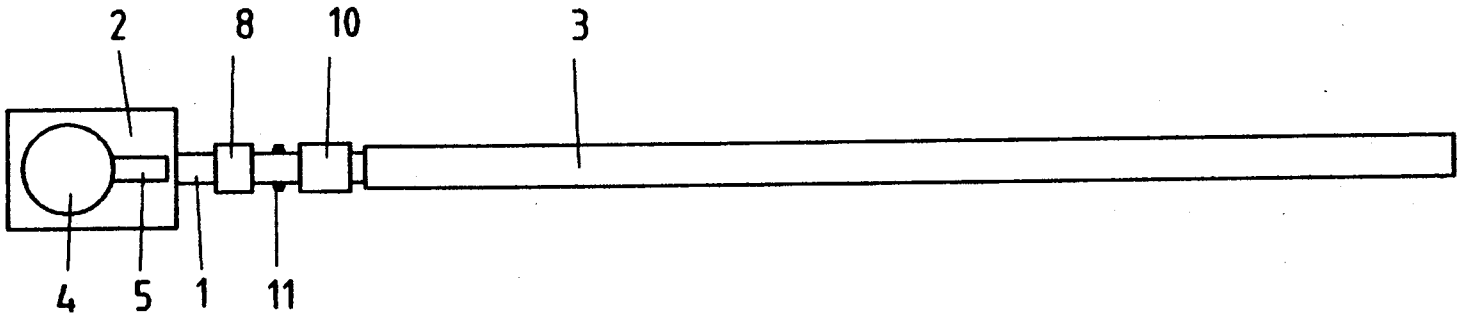
FIG. 2 is a plan view of the plant of FIG. 1.

As schematically illustrated in FIGS. 1 and 2, a plant for manufacturing steel strip 1 includes a steel strip casting plant 2 and a temperature equalizing furnace 3 and a subsequently arranged finishing rolling mill, not shown. The elements of the steel strip casting plant 2 are ladle 4, intermediate container 5, mold 6, slab guiding means 7 and straightening conveyor 8.

The vertically cast steel strip 1 is deflected into the horizontal, is aligned and conveyed into the temperature equalizing furnace 3 which is provided with a roller table 9. The continuously cast steel strip 1 is divided into sections by means of shears 10.

In order to avoid a lateral deviation of the steel strip 1 on the roller table 9 when the steel strip emerges unevenly from the steel casting plant 2, an aligning station 11 is arranged between the straightening conveyor 8 and the shears 10. In accordance with the present invention, the aligning station 11 may have the configurations illustrated in FIGS. 3, 4 and 5 of the drawing.

Figure 3:
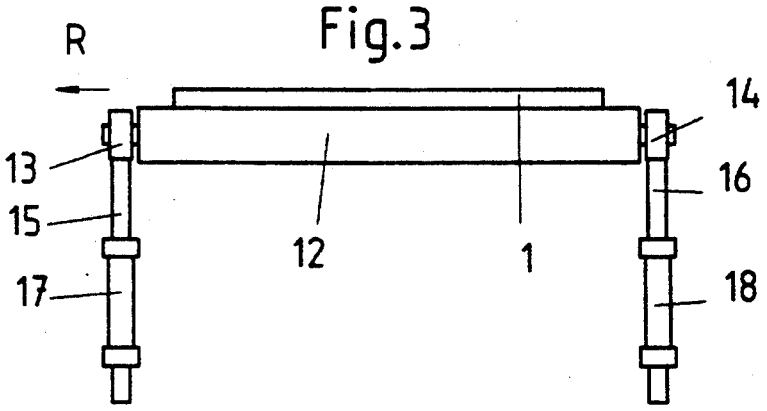
FIG. 3 is a front view, on a larger scale, of the aligning station of FIG. 1.

The aligning station illustrated in FIG. 3 includes a support roller 12 which is mounted underneath the guiding plane of the steel strip 1. The bearings 13, 14 of the support roller 12 are connected to the piston rods 15, 16 of adjusting cylinders 17, 18, respectively. Thus, when the steel strip 1 deviates in a direction R, the deviation is corrected by raising the bearing 14 arranged on the opposite side, i.e., by inclining the support roller 12.

Figure 4:
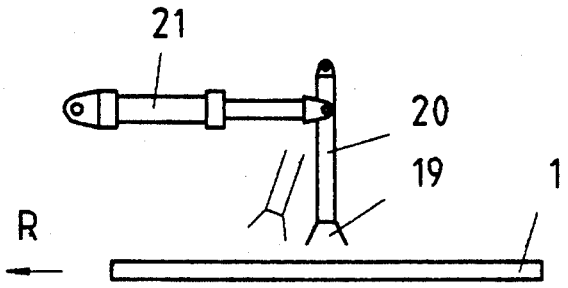
FIG. 4 is a front view of an aligning station operating according to the heating principle.

In the aligning station illustrated in FIG. 4, a gas burner 19 is mounted on a support member 20. The support member 20 is mounted above the center of the steel strip so as to be pivotable in transverse direction of the strip. By means of an adjusting cylinder 21 connected to the support member 20, the burner flame can be directed to one of the two sides of the steel strip 1 and a deviation of the steel strip can be corrected by means of a unilateral thermal expansion of the strip.

Figure 5:
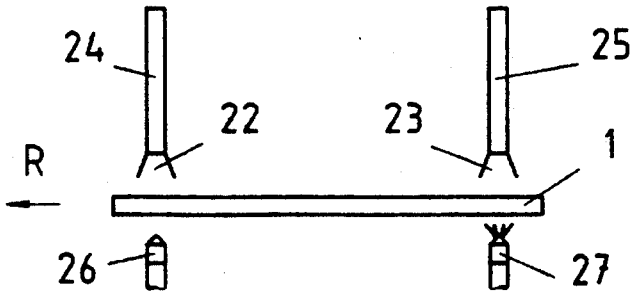
FIG. 5 is a front view of another embodiment of the aligning station according to the present invention.

In the embodiment of FIG. 5, a gas burner 22, 23 each is mounted on a stationary support member 24, 25 above the side portions of the steel strip 1. Thus, the unilateral thermal expansion desired for alignment is obtained by switching on one of the two gas burners 22 or 23.

Conversely, the steel strip 1 can also be aligned by utilizing the principle of unilateral shrinkage. For this purpose, conventional water spray nozzles 26, 27 can be used which, as shown in FIG. 5, are arranged on the underside of the steel strip. In this case, cooling water is applied to that side of the steel strip which is opposite the direction of deviation R of the steel strip 1.

The present invention is not limited to the embodiments illustrated in the drawings. For example, the aligning station can also be formed by a pair of drive rollers which can be adjusted into an inclined position in the direction of the steel strip surface or transversely thereof.

While specific embodiments of the invention have been shown and described in detail to illustrate the application of the inventive principles, it will be understood that the invention may be embodied otherwise without departing from such principles.

I claim:

1. In a plant for manufacturing steel strip, the plant including a horizontally arranged straightened conveyor for the steel strip cast in a mold and means for conveying in a conveying direction the steel strip onto a plurality of individual rollers in a temperature equalizing furnace, the improvement comprising a support roller mounted entirely underneath a strip travel plane, said support roller being means for aligning the steel strip between the straightening conveyor and the temperature equalizing furnace, the support roller having bearings at both ends thereof, the bearings being vertically adjustable independently of each other.

2. The aligning station according to claim 1, comprising a pair of drive rollers arranged downstream of the straightening conveyor, the pair of drive rollers having adjacent bearings arranged on both sides of the steel strip, the adjacent bearings on one side of the steel strip being adjustable parallel to the strip travel plane independently of the adjacent bearings on the other side of the strip.

3. In a method for aligning steel strip in a plant for manufacturing steel strip in which the steel strip cast in a mold is conveyed into a horizontally arranged straightening conveyor and subsequently into a temperature equalizing furnace, the improvement comprising determining the horizontal conveying direction of the steel strip and comparing the horizontal conveying direction with the conveying direction of the horizontal straightening conveyor, and correcting any lateral alignment error of the steel strip by horizontally deflecting the steel strip from entirely underneath said steel strip.

* * * * *